US007261806B2

(12) United States Patent
Benard et al.

(10) Patent No.: US 7,261,806 B2
(45) Date of Patent: Aug. 28, 2007

(54) PROCESS TO PREPARE A BASE OIL FROM SLACK-WAX

(75) Inventors: Gerard Benard, Petit Couronne (FR); Eric Duprey, Petit Couronne (FR); Johannes Anthonius Robert Van Veen, Amsterdam (NL)

(73) Assignee: Shell Oil Company, Houston, TX (US)

( * ) Notice: Subject to any disclaimer, the term of this patent is extended or adjusted under 35 U.S.C. 154(b) by 434 days.

(21) Appl. No.: 10/479,900

(22) PCT Filed: Jun. 7, 2002

(86) PCT No.: PCT/EP02/06301

§ 371 (c)(1),
(2), (4) Date: Dec. 5, 2003

(87) PCT Pub. No.: WO02/099014

PCT Pub. Date: Dec. 12, 2002

(65) Prior Publication Data

US 2004/0144691 A1 Jul. 29, 2004

(30) Foreign Application Priority Data

Jun. 7, 2001 (EP) ..... 01401491

(51) Int. Cl.
*C10G 45/00* (2006.01)
*C10G 73/00* (2006.01)

(52) U.S. Cl. ..... 208/89; 208/108; 208/31; 208/27

(58) Field of Classification Search ..... 208/108, 208/89, 31, 27
See application file for complete search history.

(56) References Cited

U.S. PATENT DOCUMENTS

| | | | | |
|---|---|---|---|---|
| 3,130,007 | A | 4/1964 | Breck | |
| 3,536,605 | A | 10/1970 | Kittrell | |
| 3,830,723 | A | 8/1974 | Ladeur et al. | |
| 4,574,043 | A | 3/1986 | Chester | |
| 4,859,311 | A | 8/1989 | Miller | |
| 4,975,177 | A * | 12/1990 | Garwood et al. | 208/27 |
| 5,053,373 | A | 10/1991 | Zones | |
| 5,157,191 | A | 10/1992 | Bowes et al. | |
| 5,252,527 | A | 10/1993 | Zones | |
| 5,264,116 | A * | 11/1993 | Apelian et al. | 208/111.1 |
| 5,288,395 | A * | 2/1994 | Marler et al. | 208/58 |
| 5,292,989 | A | 3/1994 | Davis | |
| 5,370,788 | A | 12/1994 | Dai et al. | |
| 5,378,351 | A | 1/1995 | Guichardi et al. | |
| 5,543,035 | A | 8/1996 | Ziemer | |
| 5,951,848 | A | 9/1999 | Baker, Jr. et al. | |
| 6,200,927 | B1 | 3/2001 | Shukis et al. | 502/355 |
| 6,239,054 | B1 | 5/2001 | Shukis et al. | 502/29 |
| 6,239,066 | B1 | 5/2001 | Shukis et al. | 502/355 |
| 6,291,394 | B1 | 9/2001 | Shukis et al. | 502/355 |

FOREIGN PATENT DOCUMENTS

| | | |
|---|---|---|
| EP | 0 537 969 | 4/1993 |
| EP | 0574191 | 12/1993 |
| EP | 0 666 894 | 8/1995 |
| EP | 0776959 A2 | 11/1996 |
| EP | 0 832 171 | 4/1998 |
| EP | 0968764 A1 | 1/2000 |
| GB | 1 493 620 | 11/1977 |
| WO | 94/10263 | 5/1994 |
| WO | 97/18278 | 5/1997 |
| WO | 99/41337 | 8/1999 |
| WO | 00/29511 | 5/2000 |
| WO | 02/46333 | 6/2002 |

OTHER PUBLICATIONS

International Search Report dated May 16, 2003.
Iishan, G., et al., "Sulfidation and Thiopene Hydrodesulfurization Activity of Nickel Tungsten Sulfide Model Catalysts, Prepared Without and With Chelating Agents", Journal of Catalysis, Academic Press, Duluth, MN, US, vol. 196, 2000, pp. 180-189.

* cited by examiner

*Primary Examiner*—Glenn Caldarola
*Assistant Examiner*—John Douglas
(74) *Attorney, Agent, or Firm*—Charles W. Stewart

(57) ABSTRACT

A process to prepare a base oil starting from a slack wax containing feedstock by (a) contacting the feedstock in the presence of hydrogen with a sulphided hydrodesulphurisation catalyst having nickel and tungsten on an acid amorphous silica-alumina carrier and (b) performing a pour point reducing step on the effluent of step (a) to obtain the base oil.

22 Claims, No Drawings

PROCESS TO PREPARE A BASE OIL FROM SLACK-WAX

FIELD OF THE INVENTION

The invention is directed to a process to prepare a base oil starting from a slack wax containing feedstock by contacting the feedstock in the presence of hydrogen with a catalyst comprising a Group VIB metal and a non-noble Group VIII metal on an amorphous carrier.

BACKGROUND OF THE INVENTION

GB-A-1493620 describes a hydroisomerisation process to prepare base oils. The catalysts, which are known to be used in such a reaction generally, comprise a hydrogenation component and an acid component. GB-A-1493620 discloses a catalyst comprising nickel and tungsten as hydrogenation components, supported on an alumina carrier. The required acidity for the catalyst is provided by the presence of fluorine.

There have been many efforts to obtain a fluorine free hydroisomerisation catalyst. For example WO-A-9941337 describes a hydroisomerisation process wherein a slack-wax containing feed is contacted with a fluorine free catalyst. The disclosed catalyst consists of a platinum or palladium metal on a silica-alumina carrier. According to this publication a hydrotreatment step is preferably performed prior to the hydroisomerisation step in order to reduce the sulphur and nitrogen content to below 2 ppm, in order to avoid deactivation of the noble metal containing hydroisomerisation catalyst.

U.S. Pat. No. 5,370,788 describes a hydroisomerisation catalyst optionally containing fluorine. U.S. Pat. No. 5,370,788 describes a slack wax hydroisomerisation process wherein a non-fluorided nickel-molybdenum on silica-alumina carrier catalyst is used having almost only pores with diameters between 60-130 Å, a total surface area of 249 $m^2/g$ an a total pore volume of 0.5 cc/g, wherein the pore volume of the pores having a pore diameter of above 500 Å is 0.05 cc/g. The catalyst is said to be sulphur tolerant. The highest base oil yield on slack-wax reported in this publication is about 38 wt % obtained when the hydroisomerisation process was performed at about 70 bar and 370° C.

EP-A-537969 describes a hydroisomerisation catalyst optionally containing fluorine. A slack wax hydroisomerisation process is described wherein a nickel-molybdenum on silica-alumina carrier catalyst is used having almost only pores with diameters below 100 Å, a total surface area of between 100 and 250 $m^2/g$. The catalyst is said to be sulphur tolerant. The high base oil yield on slack-wax are reported in this publication when the hydroisomerisation process was performed at about 70 bar and at temperatures about 400° C. According to this publication the products require a hydrofinishing step to improve their UV stability.

EP-A-666894 describes a hydroisomerisation catalyst containing no fluorine. A slack wax hydroisomerisation process is disclosed wherein a nickel-molybdenum on silica-alumina carrier catalyst is used having a certain macroporosity. The macroporosity is defined in that a considerable part of the pores have a diameter greater than 100 nm. The total pore volume is between 0.6 and 1.2 ml/g. The highest base oil yield on slack-wax reported in this publication is about 42 wt % obtained when the hydroisomerisation process was performed at 140 bar and at 391° C.

U.S. Pat. No. 5,292,989 describes a wax hydroisomerisation process wherein a catalyst is used comprising cobalt, nickel and molybdenum on a silica-alumina carrier wherein silica was deposited on the surface of the carrier. Slack wax is, according to the description, a possible feed. The sulphur and nitrogen content in the slack wax feed are preferably reduced to below 2 ppm before hydroisomerisation.

SUMMARY OF THE INVENTION

It is an object of the present invention to provide a slack wax hydroisomerisation process, which can be operated at relatively low pressures, i.e. less than 100 bar. A disadvantage of the above-described processes, which also operate at such lower pressures, is that they are performed at relatively high temperatures, i.e. higher than 390° C. A disadvantage of such higher temperatures is that the level of poly-aromatic (PCA) compounds in the product becomes too high, i.e. higher than 10 mmol/100 grams of product. Additional hydrofinishing will then be required to saturate these PCA compounds to a level lower than 10 mmol/100 grams.

DETAILED DESCRIPTION OF THE INVENTION

The object of the present invention is to provide a hydroisomerisation process to prepare base oils from slack-wax which can be performed at lower pressures and lower temperatures. A further object is that the product obtained by said process is low in polyaromatic compounds, preferably having a PCA content of less than 10 mmol/100 grams. A related aim is that the products as obtained do not require an additional hydrofinishing step in order to reduce the PCA content. A further aim is to provide a process, which is tolerant for higher levels of sulphur and nitrogen in the feed, such that a prior hydrotreating step is not necessary. Additional advantages of the present invention will become clear from the description.

The above aims are achieved with the following process. Process to prepare a base oil starting from a slack wax containing feedstock by (a) contacting the feedstock in the presence of hydrogen with a sulphided hydrodesulphurisation catalyst comprising nickel and tungsten on an acid amorphous silica-alumina carrier and (b) performing a pour point reducing step on the effluent of step (a) to obtain the base oil.

Applicants have found that by using a nickel/tungsten containing catalyst having a relatively high hydrodesulphurisation (HDS) activity and an acid amorphous silica-alumina carrier in step (a) a base oil can be prepared in a high yield at low pressures and temperatures, wherein the base oil product has an acceptable content of polyaromatic compounds. With relatively high hydrodesulphurisation activity is here meant a higher activity when compared to state of the art nickel/tungsten containing catalysts. Further advantages will be apparent from the below description.

The slack-wax containing feed may also contain other wax sources, for example Fischer-Tropsch derived wax. Suitably the content of slack-wax in the feed will be more than 50 wt %, preferably more than 80 wt % up to 100 wt %.

The slack-wax is suitably obtained in a solvent dewaxing process, which can be part of a process to prepare base oils. The slack wax thus obtained suitably has a mean boiling point between 400 and 600° C. The oil content in the wax, as determined by ASTM D721, is suitably between 0 and 50 wt %. The slack-wax feed may contain between 0 and 1 wt % sulphur and between 0 and 150 ppm nitrogen. It has been found that the catalyst employed in the process according to the invention is relatively stable when sulphur and/or nitrogen are part of the feed. This is advantageous because a prior desulphurisation step, also referred to as hydrotreating step, can thus be avoided.

If one base oil grade, having for example a specific kinematic viscosity at 100° C., is made at a time the boiling range of the slack wax feed is preferably rather narrow, more preferably the difference between the temperature at which 10 wt % is recovered and the temperature at which 90 wt % is recovered is preferably between 80 and 160° C. and preferably below 130° C. If one intends to prepare two or more base oil grades having different viscosity properties at a time a more wider boiling slack wax feed is preferably used. Such a more wider boiling slack wax feed preferably has a difference between the temperature at which 10 wt % is recovered and the temperature at which 90 wt % is recovered of between 170° C. and 300° C. and more preferably between 170° C. and 250° C. The different base oil grades having a kinematic viscosity at 100° C. of between 2 and 10 cSt and having excellent Noack volatility properties of at most 17 wt % for the lower viscosity grades and even lower for the more heavier viscosity grades may be advantageously be prepared by isolating such grades from preferably the effluent of step (a) by means of a distillation step.

The catalyst employed in step (a) preferably comprises between 2-10 wt % nickel and between 5-30 wt % tungsten.

The sulphided hydrodesulphurisation catalyst used in step (a) has a relatively high hydrodesulphurisation activity. With relatively high activity is here meant a considerably higher activity when compared to state of the art nickel/tungsten containing catalysts based on a silica-alumina carrier. Preferably the hydrodesulphurisation activity of the catalyst is higher than 30% and more preferably below 40%, and most preferably below 35%, wherein the hydrodesulphurisation activity is expressed as the yield in weight percentage of $C_4$-hydrocarbon cracking products when thiophene is contacted with the catalyst under standard hydrodesulphurisation conditions. The standard conditions consists of contacting a hydrogen/thiophene mixture with 200 mg of a 30-80 mesh sulphided catalyst at 1 bar and 350° C., wherein the hydrogen rate is 54 ml/min and the thiophene concentration is 6 vol % in the total gas feed.

Catalyst particles are to be used in the test are first crushed and sieved through a 30-80 mesh sieve. The catalyst is then dried for at least 30 minutes at 300° C. before loading 200 mg of dried catalyst into a glass reactor. Then the catalyst is pre-sulphided by contacting the catalyst for about 2 hours with an $H_2S/H_2$ mixture, wherein the $H_2S$ rate is 8.6 ml/min and the $H_2$ rate is 54 ml/min. The temperature during the pre-sulphiding procedure is raised from room temperature, 20° C., to 270° C. at 10° C./min and held for 30 minutes at 270° C. before raising it to 350° C. at a rate of 10° C./min. During pre-sulphiding nickel and tungsten oxides are converted to the active metal sulphides. After pre-sulphiding the $H_2S$ flow is stopped and $H_2$ is bubbled at a rate of 54 ml/min through two thermostatted glass vessels containing thiophene. The temperature of the first glass vessel is kept at 25° C. and the temperature of the second glass vessel is kept at 16° C. As the vapour pressure of thiophene at 16° C. is 55 mmHg, the hydrogen gas that enters the glass reactor is saturated with 6 vol % thiophene. The test is performed at 1 bar and at a temperature of 350° C. The gaseous products are analysed by an online gas liquid chromatograph with a flame ionisation detector every 30 minutes for four hours.

In order to obtain a reproducible value for the hydrodesulphurisation activity the test values as obtained by the above method are corrected such to correspond to the hydrodesulphurisation activity of a reference catalyst. The reference catalyst is the commercial C-454 catalyst as obtainable at the date of filing of Criterion Catalyst Company (Houston) and its reference hydrodesulphurisation activity is 22 wt % according to the above test. By testing both the reference catalyst ("test C-454") and the test catalyst ("measured val") one can easily calculate a consistent actual hydrodesulphurisation activity according to the above test with the below equation:

Actual activity="measured val"+((22−"test *C*-454")/22)*"measured val"

The hydrodesulphurisation activity of the nickel/tungsten catalyst can be improved by using chelating agents in the impregnation stage of the preparation of the catalyst as for example described by Kishan G., Coulier L., de Beer V. H. J., van Veen J. A. R., Niemantsverdriet J. W., Journal of Catalysis 196, 180-189 (2000). Examples of chelating agents are nitrilotriacetic acid, ethylenediaminetetraacetic acid (EDTA) and 1,2-cyclohexanediamine-N,N,N',N',-tetraacetic acid.

The carrier for the catalyst is amorphous silica-alumina. The term "amorphous" indicates a lack of crystal structure, as defined by X-ray diffraction, in the carrier material, although some short range ordering may be present. Amorphous silica-alumina suitable for use in preparing the catalyst carrier is available commercially. Alternatively, the silica-alumina may be prepared by precipitating an alumina and a silica hydrogel and subsequently drying and calcining the resulting material, as is well known in the art. The carrier is an amorphous silica-alumina carrier. The amorphous silica-alumina preferably contains alumina in an amount in the range of from 5 to 75% by weight, more preferably from 10 to 60% by weight as calculated on the carrier alone. A very suitable amorphous silica-alumina product for use in preparing the catalyst carrier comprises 45% by weight silica and 55% by weight alumina and is commercially available (ex. Criterion Catalyst Company, USA).

The total surface area of the catalyst as determined by is preferably above 100 $m^2/g$ and more preferably between 200 and 300 $m^2/g$. The total pore volume is preferably above 0.4 ml/g. The upper pore volume will be determined by the minimum surface area required. Preferably between 5 and 40 volume percent of the total pore volume is present as pores having a diameter of more than 350 Å. References to the total pore volume are to the pore volume determined using the Standard Test Method for Determining Pore Volume Distribution of Catalysts by Mercury Intrusion Porosimetry, ASTM D 4284-88.

The catalyst is sulphided. Sulphidation of the catalyst may be effected by any of the techniques known in the art, such a ex-situ or in-situ sulphidation. For example, Sulphidation may be effected by contacting the catalyst with a sulphur-containing gas, such as a mixture of hydrogen and hydrogen sulphide, a mixture of hydrogen and carbon disulphide or a mixture of hydrogen and a mercaptan, such as butylmercaptan. Alternatively, sulphidation may be carried out by contacting the catalyst with hydrogen and sulphur-containing hydrocarbon oil, such as sulphur-containing kerosene or gas oil. The sulphur may also be introduced into the hydrocarbon oil by the addition of a suitable sulphur-containing compound, for example dimethyldisulphide or tertiononylpolysulphide.

The feedstock will preferably comprise a minimum amount of sulphur in order to keep the catalyst in a sulphided state. Preferably at least 200 ppm sulphur and more preferably at least 700 ppm sulphur is present in the feed. It may be therefore be necessary to add additional sulphur, for example as dimethylsulphide, or a sulphur containing co-feed to the feed of step (a) if the slack wax contains a lower level of sulphur. Examples of slack wax feed, which contain lower levels of sulphur, are slack waxes obtained from oil, which has been obtained in a hydrocracking process. Such slack waxes may contain between 10-200 ppm sulphur.

The amorphous silica-alumina carrier of the catalyst preferably has a certain minimum acidity or, said in other words, a minimum cracking activity. Examples of suitable carriers having the required activity are described in WO-A-9941337. More preferably the catalyst carrier, after having been calcined, at a temperature of suitably between 400 and 1000° C., has a certain minimum n-heptane cracking activity as will be described in more detail below.

The n-heptane cracking is measured by first preparing a standard catalyst consisting of the calcined carrier and 0.4 wt % platinum. Standard catalysts are tested as 40-80 mesh particles, which are dried at 200° C. before loading in the test reactor. The reaction is carried out in a conventional fixed-bed reactor having a length to diameter ratio of 10 to 0.2. The standard catalysts are reduced prior to testing at 400° C. for 2 hrs at a hydrogen flow rate of 2.24 Nml/min and a pressure of 30 bar. The actual test reaction conditions are: n-heptane/$H_2$ molar ratio of 0.25, total pressure 30 bar, and a gas hourly space velocity of 1020 Nml/(g·h). The temperature is varied by decreasing the temperature from 400° C. to 200° C. at 0.22° C./minute. Effluents are analysed by on-line gas chromatography. The temperature at which 40 wt % conversion is achieved is the n-heptane test value. Lower n-heptane test values correlate with more active catalyst.

Preferred carriers have an n-heptane cracking temperature of less than 360° C., more preferably less than 350° C. and most preferably less than 345° C. as measured using the above-described test. The minimum n-heptane cracking temperature is preferably more than 310° C. and more preferably greater than 320° C.

The cracking activity of the silica-alumina carrier can be influenced by, for example, variation of the alumina distribution in the carrier, variation of the percentage of alumina in the carrier, and the type of alumina, as is generally known to one skilled in the art. Reference in this respect is made to the following articles which illustrate the above: Von Bremer H., Jank M., Weber M., Wendlandt K. P., Z. anorg. allg. Chem. 505, 79-88 (1983); Léonard A. J., Ratnasamy P., Declerck F. D., Fripiat J. J., Disc. of the Faraday Soc. 1971, 98-108; and Toba M. et al, J. Mater. Chem., 1994, 4(7), 1131-1135.

The catalyst may also comprise up to 8 wt % of a large pore molecular sieve, preferably an aluminosilicate zeolite. Such zeolites are well known in the art, and include, for example, zeolites such as X, Y, ultrastable Y, dealuminated Y, faujasite, ZSM-12, ZSM-18, L, mordenite, beta, offretite, SSZ-24, SSZ-25, SSZ-26, SSZ-31, SSZ-33, SSZ-35 and SSZ-37, SAPO-5, SAPO-31, SAPO-36, SAPO-40, SAPO-41 and VPI-5. Large pore zeolites are generally identified as those zeolites having 12-ring pore openings. W. M. Meier and D. H. Olson, "ATLAS OF ZEOLITE STRUCTURE TYPES" 3rd Edition, Butterworth-Heinemann, 1992, identify and list examples of suitable zeolites. If a large pore molecular sieve is used then the well-known synthetic zeolite Y as for example described in U.S. Pat. No. 3,130,007 and ultrastable Y zeolite as for example described in U.S. Pat. No. 3,536,605 are suitable molecular sieves. Other suitable molecular sieves are ZSM-12, zeolite beta and mordenite. Such molecular sieve containing catalysts, containing between 0.1 and 8 wt % of the sieve, are especially used when the reactor containing the catalyst is alternatingly used as a hydrocracker reactor to prepare middle distillate fuels and as a reactor to prepare base oils.

The catalyst for use in step (a) may be prepared by any of the suitable catalyst preparation techniques known in the art. A preferred method for the preparation of the carrier comprises mulling a mixture of the amorphous silica-alumina and a suitable liquid, extruding the mixture and drying and calcining the resulting extrudates as for example described in EP-A-666894. The extrudates may have any suitable form known in the art, for example cylindrical, hollow cylindrical, multilobed or twisted multilobed. A most suitable shape for the catalyst particles is cylindrical. Typically, the extrudates have a nominal diameter of from 0.5 to 5 mm, preferably from 1 to 3 mm. After extrusion, the extrudates are dried. Drying may be effected at an elevated temperature, preferably up to 800° C., more preferably up to 300° C. The period for drying is typically up to 5 hours, preferably from 30 minutes to 3 hours. Preferably, the extrudates are calcined after drying. Calcination is effected at an elevated temperature, preferably between 400 and 1000° C. Calcination of the extrudates is typically effected for a period of up to 5 hours, preferably from 30 minutes to 4 hours. Once the carrier has been prepared, nickel and tungsten may be deposited onto the carrier material. Any of the suitable methods known in the art may be employed, for example ion exchange, competitive ion exchange and impregnation. Preferably nickel and tungsten are added by means of impregnation using a chelating agent as described above. After impregnation, the resulting catalyst is preferably dried and calcined at a temperature of between 200 and 500° C.

The hydroisomerisation process is conducted at elevated temperature and pressure. Suitable operating temperatures for the process are in the range of from 290° C. to 370° C., preferably in the range of from 320° C. to 360° C. Preferred total pressures are in the range of from 20 to 100 bar and more preferred from 40-90 bar. Base oil having a viscosity index of between 120-150 can be obtained under these conditions in high yields. The hydrocarbon feed is typically treated at a weight hourly space velocity in the range of from 0.5 to 1.5 kg/l/h, more preferably in the range of from 0.5 to 1.2 kg/l/h.

The feed may be contacted with the catalyst in the presence of pure hydrogen. Alternatively, it may be more convenient to use a hydrogen-containing gas, typically containing greater than 50% vol. hydrogen, more preferably greater than 60% vol hydrogen. A suitable hydrogen-containing gas is gas originating from a catalytic reforming plant. Hydrogen-rich gases from other hydrotreating operations may also be used. The hydrogen-to-oil ratio is typically in the range of from 300 to 5000 l/kg, preferably from 500 to 2500 l/kg, more preferably 500 to 2000 l/kg, the volume of hydrogen being expressed as standard liters at 1 bar and 0° C.

In step (b) the effluent of step (a) is subjected to a pour point reducing treatment. With a pour point reducing treatment is understood every process wherein the pour point of the base oil is reduced by more than 10° C., preferably more than 20° C., more preferably more than 25° C.

The pour point reducing treatment can be performed by means of a so-called solvent dewaxing process or by means of a catalytic dewaxing process. Solvent dewaxing is well known to those skilled in the art and involves admixture of one or more solvents and/or wax precipitating agents with the base oil precursor fraction and cooling the mixture to a temperature in the range of from −10° C. to −40° C., preferably in the range of from −20° C. to −35° C., to separate the wax from the oil. The oil containing the wax is usually filtered through a filter cloth which can be made of textile fibres, such as cotton; porous metal cloth; or cloth made of synthetic materials. Examples of solvents which may be employed in the solvent dewaxing process are $C_3$-$C_6$ ketones (e.g. methyl ethyl ketone, methyl isobutyl ketone and mixtures thereof), $C_6$-$C_{10}$ aromatic hydrocarbons (e.g. toluene), mixtures of ketones and aromatics (e.g. methyl ethyl ketone and toluene), autorefrigerative solvents such as liquefied, normally gaseous $C_2$-$C_4$ hydrocarbons such as propane, propylene, butane, butylene and mixtures thereof. Mixtures of methyl ethyl ketone and toluene or methyl ethyl ketone and methyl isobutyl ketone are generally preferred. Examples of these and other suitable solvent dewaxing processes are described in Lubricant Base Oil and Wax Processing, Avilino Sequeira, Jr, Marcel Dekker Inc., New York, 1994, Chapter 7.

The wax obtained in the solvent dewaxing step (b) is preferably recycled to step (a).

Alternatively step (b) is performed by means of a catalytic dewaxing process. Such a process is preferred when for example lower pour points are desired than which can be achieved with solvent dewaxing. Pour points of well below −30° C. can be easily achieved. The catalytic dewaxing process can be performed by any process wherein in the presence of a catalyst and hydrogen the pour point of the base oil precursor fraction is reduced as specified above. Suitable dewaxing catalysts are heterogeneous catalysts comprising a molecular sieve and optionally in combination with a metal having a hydrogenation function, such as the Group VIII metals. Molecular sieves, and more suitably intermediate pore size zeolites, have shown a good catalytic ability to reduce the pour point of the base oil precursor fraction under catalytic dewaxing conditions. Preferably the intermediate pore size zeolites have a pore diameter of between 0.35 and 0.8 nm. Suitable intermediate pore size zeolites are ZSM-5, ZSM-12, ZSM-22, ZSM-23, SSZ-32, ZSM-35 and ZSM-48. Another preferred group of molecular sieves are the silica-aluminaphosphate (SAPO) materials of which SAPO-11 is most preferred as for example described in U.S. Pat. No. 4,859,311. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Ni/ZSM-5, Pt/ZSM-23, Pd/ZSM-23, Pt/ZSM-48 and Pt/SAPO-11. Further details and examples of suitable molecular sieves and dewaxing conditions are for example described in WO-A-9718278, U.S. Pat. No. 5,053,373, U.S. Pat. No. 5,252,527 and U.S. Pat. No. 4,574,043.

The dewaxing catalyst suitably also comprises a binder. The binder can be a synthetic or naturally occurring (inorganic) substance, for example clay, silica and/or metal oxides. Natural occurring clays are for example of the montmorillonite and kaolin families. The binder is preferably a porous binder material, for example a refractory oxide of which examples are: alumina, silica-alumina, silica-magnesia, silica-zirconia, silica-thoria, silica-beryllia, silica-titania as well as ternary compositions for example silica-alumina-thoria, silica-alumina-zirconia, silica-alumina-magnesia and silica-magnesia-zirconia. More preferably a low acidity refractory oxide binder material which is essentially free of alumina is used. Examples of these binder materials are silica, zirconia, titanium dioxide, germanium dioxide, boria and mixtures of two or more of these of which examples are listed above. The most preferred binder is silica.

A preferred class of dewaxing catalysts comprise intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. These catalysts may be advantageously used because they allow small amounts of sulphur and nitrogen in the feed. A preferred dealumination treatment is by contacting an extrudate of the binder and the zeolite with an aqueous solution of a fluorosilicate salt as described in for example U.S. Pat. No. 5,157,191 or WO-A-0029511. Examples of suitable dewaxing catalysts as described above are silica bound and dealuminated Pt/ZSM-5, silica bound and dealuminated Pt/ZSM-23, silica bound and dealuminated Pt/ZSM-12, silica bound and dealuminated Pt/ZSM-22, as for example described in WO-A-0029511 and EP-B-832171.

Catalytic dewaxing conditions are known in the art and typically involve operating temperatures in the range of from 200 to 500° C., suitably from 250 to 400° C., hydrogen pressures in the range of from 10 to 200 bar. Although lower pressures between 40 to 70 bar are generally preferred for the dewaxing step, the pressure will suitably be in the same range as step (a). Thus when step (a) is performed at a pressure above 70 bar, the dewaxing step will suitably also be performed at a pressure above 70 bar. The weight hourly space velocities (WHSV) is suitably in the range of from 0.1 to 10 kg of oil per liter of catalyst per hour (kg/l/hr), and preferably from 0.2 to 5 kg/l/hr, more preferably from 0.5 to 3 kg/l/hr and hydrogen to oil ratios in the range of from 100 to 2,000 liters of hydrogen per liter of oil.

Before performing a catalytic dewaxing step hydrogen sulphide and ammonia formed in step (a) are preferably removed from the effluent of step (a). This can be performed by for example stripping, preferably using hydrogen as stripping gas.

The effluent of a catalytic dewaxing step (b) is optionally subjected to an additional hydrogenation step (c), also referred to as a hydrofinishing step to saturate any olefins formed in the catalytic dewaxing step. In this hydrogenation step any (poly)aromatic compounds still present in the dewaxed oil can be saturated and/or the oxidative stability of base oil may be improved. This step is suitably carried out at a temperature between 230 and 380° C., a total pressure of between 10 to 250 bar and preferably above 100 bar and more preferably between 120 and 250 bar. The WHSV (Weight Hourly Space Velocity) ranges from 0.3 to 2 kg of oil per liter of catalyst per hour (kg/l·h).

The hydrogenation catalyst is suitably a supported catalyst comprising a dispersed Group VIII metal. Possible Group VIII metals are cobalt, nickel, palladium and platinum. Cobalt and nickel containing catalysts may also comprise a Group VIB metal, suitably molybdenum and tungsten. Suitable carrier or support materials are low acidity amorphous refractory oxides. Examples of suitable amorphous refractory oxides include inorganic oxides, such as alumina, silica, titania, zirconia, boria, silica-alumina, fluorided alumina, fluorided silica-alumina and mixtures of two or more of these.

Examples of suitable hydrogenation catalysts are nickel-molybdenum containing catalyst such as KF-847 and KF-8010 (AKZO Nobel) M-8-24 and M-8-25 (BASF), and C-424, DN-190, HDS-3 and HDS-4 (Criterion); nickel-tungsten containing catalysts such as NI-4342 and NI-4352 (Engelhard) and C-454 (Criterion); cobalt-molybdenum containing catalysts such as KF-330 (AKZO-Nobel), HDS-22 (Criterion) and HPC-601 (Engelhard). Preferably platinum containing and more preferably platinum and palladium containing catalysts are used. Preferred supports for these palladium and/or platinum containing catalysts are amorphous silica-alumina. Examples of suitable silica-alumina carriers are disclosed in WO-A-9410263. A preferred catalyst comprises an alloy of palladium and platinum preferably supported on an amorphous silica-alumina carrier of which the commercially available catalyst C-624 of Criterion Catalyst Company (Houston, Tex.) is an example.

The invention will be illustrated with the following non-limiting examples.

EXAMPLE 1

An LH-21 catalyst as obtained from Criterion Catalyst Company (Houston) was loaded into a reactor and retained as a fixed bed. The LH-21 catalyst had a hydrodesulphurisation activity of 32%. The carrier of this catalyst had a heptane cracking test value of between 320 and 345° C.

A slack wax, having an oil content of 34.7 wt % (as determined by solvent dewaxing at −27° C.), nitrogen content of 3 mg/kg, a sulphur content of 10 mg/kg and a boiling range:

| | |
|---|---|
| Initial boiling point | 347° C. |
| 30 wt % | 468° C. |
| 50 wt % | 491° C. |
| 95 wt % | 591° C. |
| Final boiling point | 596° C. |

was fed to the reactor at a weight hourly space velocity of 1 kg/l/h. The feed was spiked with dimethyldisulphide such that the total content of sulphur in the feed was 0.1 wt %. Hydrogen was fed to the reactor at an inlet pressure of 50 bar and at a flowrate of 1500 Nl/h. The reaction temperature was 350° C.

The hydrocarbon product was distilled to remove that fraction of the product having a boiling point below 370° C. and further refined by solvent dewaxing at a temperature of −27° C. The remaining oil was collected. The yield of oil, expressed as wt % of the feed, was 45 wt %. The viscosity index was 138. The kinematic viscosity at 100° C. was 5.1 cSt and at 40° C. was 25 cSt. The content of aromatics, including polyaromatics, was below 6 mmol/100 grams of product.

EXAMPLE 2

Example 1 was repeated at 90 bar and at 354° C. The yield of oil, expressed as wt % of the feed, was 40 wt %. The viscosity index was 138 and the content of aromatics, including polyaromatics, was below 2 mmol/100 grams.

Comparative Experiment A

Example 1 was repeated with a commercial fluorided C-454 catalyst as obtained from the Criterion Catalyst Company at 390° C. The yield of oil, expressed as wt % of the feed, was 47 wt %. A darker base oil product was obtained, wherein the content of mono aromatics was 17.1 mmol/100 g and the amount of diaromatics and polyaromatics was 11.4 mmol/100 g.

We claim:

1. A process to prepare a base oil starting from a slack wax containing feedstock by (a) contacting the slack wax containing feedstock in the presence of hydrogen and under process conditions that include an operating temperature in the range of from 290° C. to 370° C. and a total pressure in the range of from 20 bar to 100 bar with a sulphided hydrodesulphurisation catalyst comprising nickel and tungsten on an acid amorphous silica-alumina carrier; and yielding an effluent, wherein in the preparation of the sulphided hydrodesulphurisation catalyst nickel and tungsten are deposited onto the acid amorphous silica-alumina carrier by means of impregnation using a chelating agent, and wherein the acid amorphous silica-alumina carrier has an n-heptane cracking test value in the range of from 310° C. to 360° C., wherein the n-heptane cracking test value is obtained by measuring the temperature at which 40 wt % of n-heptane is converted when contacted, under standard test conditions, with a catalyst consisting of said carrier and 0.4 wt % platinum, and wherein the sulphided hydrodesulphurisation catalyst has a hydrodesulphurisation activity greater than 30%, wherein the hydrodesulphurisation activity is expressed as the yield in weight percentage of $C_4$-hydrocarbon cracking products when thiophene is contacted with the catalyst under standard hydrodesulphurisation conditions, wherein the standard hydrodesulphurisation conditions consist of contacting a hydrogen-thiophene mixture with 200 mg of a 30-80 mesh catalyst at 1 bar and 350° C., wherein the hydrogen rate is 54 ml/min and the thiophene concentration is 6 vol % in the mixture, and wherein the total pore volume of the sulphided hydrodesulphurisation catalyst is above 0.4 ml/g; and (b) performing a pour point reducing step on the effluent of step (a) to obtain the base oil, wherein the base oil has a content of polyaromatic compounds of less than 10 mmol/100 grams.

2. The process according to claim 1, wherein the hydrodesulphurisation activity of the catalyst is lower than 40%.

3. The process according to claim 2, wherein the alumina content of the hydrodesulphurisation catalyst is between 10 wt % and 60 wt % as calculated on the carrier alone.

4. The process according to claim 3, wherein the acid amornhous silica-alumina carrier has an n-heptane cracking test value of between 320° C. and 350° C.

5. The process according to claim 4, wherein the sulphided hydrodesulphurisation catalyst comprises between 2-10 wt % nickel and between 5-30 wt % tungsten.

6. The process according to claim 5, wherein the surface area of the sulphided hydrodesulphurisation catalyst is between 200 $m^2/g$ and 300 $m^2/g$.

7. The process according to claim 6, wherein between 5 and 40 volume percent of the total pore volume of the sulphided hydrodesulphurisation catalyst is present as pores having a pore diameter of more than 350 Å.

8. The process according to claim 7, wherein the slack wax containing feedstock in step (a) contains more than 700 ppm sulphur.

9. The process according to claim 8, wherein the operating temperature in step (a) is between 320° C. and 370° C.

10. The process according to claim 9, wherein the total pressure in step (a) is between 40 bar and 90 bar.

11. The process according to claim 10, wherein step (b) is performed by means of solvent dewaxing.

12. The process according to claim 11, wherein the wax as obtained by solvent dewaxing is recycled to step (a).

13. The process according to claim 10, wherein step (b) is performed by means of catalytic dewaxing.

14. The process according to claim 13, wherein the effluent of step (b) is subjected to a hydrogenation step (c).

15. The process according to claim 14, wherein the slack wax has a mean boiling point of between 400° C. and 600° C. and an oil content of between 0 wt % and 50 wt % as determined by ASTM D721.

16. The process according to claim 15, wherein the difference between the temperature at which 10 wt % of the slack wax containing feedstock is recovered and the temperature at which 90 wt % of the slack wax containing feedstock is recovered is between 80° C. and 160° C.

17. The process according to claim 15, wherein the difference between the temperature at which 10 wt % of the slack wax containing feedstock is recovered and the temperature at which 90 wt % of the slack wax containing feedstock is recovered is between 170° C. and 300° C.

18. The process according to claim 17, wherein two or more base oils are prepared by isolating two or more intermediate fractions from the effluent of step (a) and performing step (b) on the isolated fractions to obtain the different base oils.

19. The process according to claim 18, wherein the base oil as obtained in step (b) has a viscosity index of between 120 and 110.

20. The process according to claim 19, wherein the catalyst in step (a) also comprises of up to 8 wt % of a large pore molecular sieve.

21. The process according to claim 20, wherein the large pore molecular sieve is a Y, ultrastable Y, ZSM-12, zeolite beta or mordenite molecular sieve.

22. The process according to claim 21, wherein the catalyst of step (a) is alternatingly used in a process to prepare middle distillate fuels.

* * * * *